United States Patent [19]

Salmonson

[11] Patent Number: 4,509,402

[45] Date of Patent: Apr. 9, 1985

[54] MAGNETIC REVERSING MECHANISM

[75] Inventor: Duane L. Salmonson, Cottage Grove, Minn.

[73] Assignee: Economics Laboratory, Inc., St. Paul, Minn.

[21] Appl. No.: 502,251

[22] Filed: Jun. 8, 1983

[51] Int. Cl.[3] ..... F01L 25/08; F01L 23/00

[52] U.S. Cl. ..... 91/275; 91/341 R; 91/344; 91/DIG. 4; 251/65

[58] Field of Search ..... 91/337, 275, DIG. 4, 91/341 R, 344; 251/65

[56] References Cited

U.S. PATENT DOCUMENTS

| | | | |
|---|---|---|---|
| 1,447,962 | 3/1923 | Callaghan | 91/275 |
| 1,922,513 | 8/1933 | Wiedmann | 25/55 |
| 1,953,454 | 4/1934 | Wollaeger | 219/3 |
| 2,462,571 | 2/1949 | Thompson et al. | 121/148 |
| 2,757,645 | 8/1956 | LeClair | 121/148 |
| 2,960,971 | 11/1960 | Tear | 121/164 |
| 3,013,531 | 12/1961 | Mueller et al. | 91/275 |
| 3,192,865 | 7/1965 | Klempoy | 91/275 |
| 3,299,826 | 1/1967 | Williams | 103/152 |
| 3,304,126 | 2/1967 | Rupp et al. | 302/21 |
| 3,421,448 | 1/1969 | Brewer et al. | 103/152 |
| 3,609,425 | 9/1971 | Sheridan | 251/65 |
| 3,622,250 | 11/1971 | Conlee | 417/397 |
| 3,847,371 | 11/1974 | Norton | 91/275 |

*Primary Examiner*—Paul E. Maslousky

*Attorney, Agent, or Firm*—Merchant, Gould, Smith, Edell, Welter & Schmidt

[57] ABSTRACT

A magnetic snap-action directional control valve mechanism preferably for use with a fluid pressure actuated reciprocating motor or pump (28). A driven member, represented by a tie rod assembly (42) in the described preferred embodiment, is caused to reciprocate at the same frequency as the reciprocating motor (28) due to contact of the driven member by a sealing member within the motor as represented by a piston (36) in the described preferred embodiment. The driven member includes a magnetic area which magnetically interacts with another magnetic area on the valve core of the magnetic directional control valve, thus causing the valve core (19) to also reciprocate at the motor frequency. Due to the nature of the magnetic interaction between the magnetic areas, the valve core (19) reciprocates in a snap-action fashion.

19 Claims, 8 Drawing Figures

FIG. 4
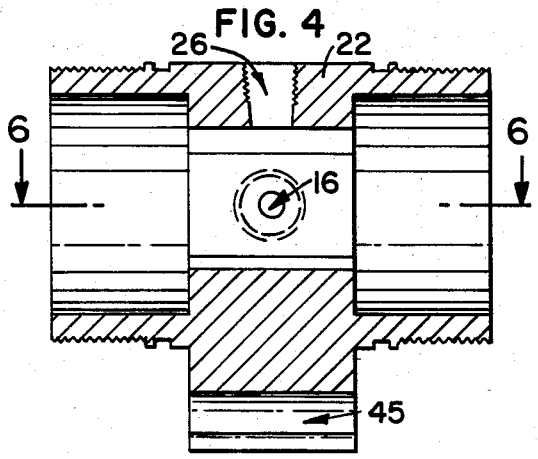
FIG. 7
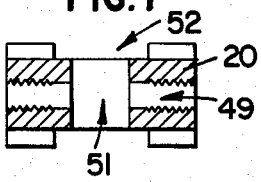
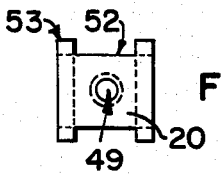
FIG. 8
FIG. 5
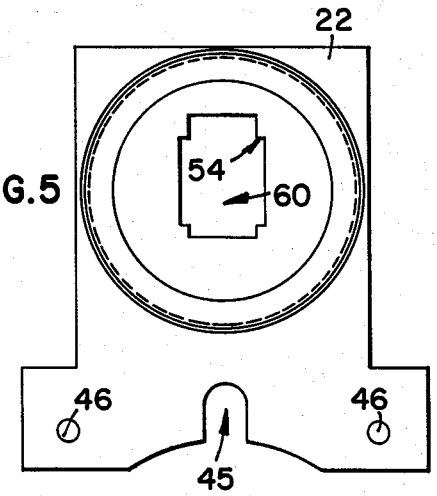
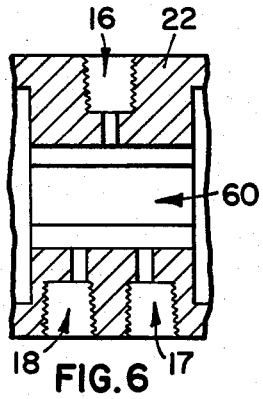
FIG. 6

MAGNETIC REVERSING MECHANISM

TECHNICAL FIELD

The invention of the present application relates generally to the field of directional control valves, and more particularly to a mechanism for automatically reversing a fluid powered reciprocating motor wherein the mechanism is magnetically operated so that a directional control valve is caused to reciprocate at the same frequency as the motor.

BACKGROUND OF THE INVENTION

Motors that are powered by propulsive fluids are very common and useful. One use for such motors is for powering a pump. Propulsive fluids include air, hydraulic oil, and water and are typically pressurized by a pump.

There are at least two general types of fluid driven motors. "Continuous" motors, e.g. rotary vane motors, include sealing members that move in a continuous fashion. "Reciprocating" motors, on the other hand, include sealing members that reciprocate or oscillate between a first position and a second position. A very common type of reciprocating motor has a single or double sided poston.

A reciprocating motor typically includes a sealing member in a chamber that divides the chamber into two subchambers. In the single-sided piston embodiment, a pressurized fluid in the first subchamber causes the piston to move in a first direction and a spring returns the piston in a second direction. In the double-sided embodiment, the propulsive fluid is on both sides of the piston and the piston moves in response to a differential pressure across it. Reciprocation of the double-sided reciprocating motor is caused by pressurizing the first subchamber while venting the second subchamber, then venting the first while pressurizing the second. The pressurizing and venting cycle is repeated to cause the piston to reciprocate. The frequency at which the motor reciprocates typically depends on the flow rate of the propulsive fluid, among other things. This frequency can be termed the "motor frequency".

In order to reciprocate the sealing member, a valve system is normally occupied to the motor. The valve system places the first subchamber in fluid communication with a higher pressure than the second subchamber, causing the sealing member to move, including simply deforming as in the case of a diaphragm. The valve system switches when the sealing member reaches the end of its "stroke" so that the first subchamber is vented and the second subchamber is pressurized. The valve system must therefore reciprocate between a first position and a second position at the motor frequency.

Additionally, the valve system should preferably have the characteristic of "over-center" or "snap" action. That is, the valve system should remain in a first position until the sealing member reaches the end of its stroke and then snap to a second position. Otherwise, if it does not snap between its first and second positions, the valve system can reach an equilibrium condition in which the sealing member is in an intermediate static state and the valve system is likewise in an equilibrium state. In such a set of conditions, the sealing member ceases to move and the motor "stalls."

One method to accomplish snap action involves the use of a linkage that includes springs. Such systems typically involve several moving parts and reliable and repeatable performance depends on the springs which can fail or lose calibration.

Magnetic fields have also been used to achieve a snap acting valve system. Magnetic forces drop off rapidly with increasing distance from the source of the field. This property makes magnets useful for snap action mechanisms as discussed below. Prior art designs for reversing mechanisms that incorporate magnets suffer from various disadvantages, however, as will also be discussed below.

One class of devices, represented by U.S. Pat. No. 3,299,826, couples a member that moves in synchrony with the reciprocating sealing member to a magnet with a spring. That is, the member is acted on by a magnetic force and by a spring, the forces being in opposition. As the sealing member moves the spring force increases until it is sufficiently large to overcome the magnetic force, and the spring causes the member to snap to a second position, thus causing a valve system to switch to a second state to force the sealing member in the opposite direction. One problem with this type of system is that if the magnet dissipates in strength or decay the sealing member will tend to have a shorter stroke, since the spring force will overcome the magnetic force at an earlier point in the sealing member's stroke. Another problem with this type of system involves the springs themselves. If the spring constant changes as the spring ages, the valve system will again have a different switching point with respect to the stroke of the sealing member. Generally, as the spring changes the snap action will have a different characteristic. In fact, the spring might fail altogether due to repeated cycling.

Another class of magnetic reversing mechanisms is represented by U.S. Pat. No. 3,304,126. In this type of mechanism springs are not used. A core of a directional control valve is acted on by magnetic forces and fluid pressure forces. The core is in fluid communication with the subchambers and when the differential pressure across the core is larger than the magnetic forces, the core will move from a first to a second state. One problem with this type of mechanism is that it is relatively complex. Additional porting is needed to communicate the pressures in the subchambers to opposing surfaces on the valve core. Also, as in the case of the magnet/spring mechanisms discussed above, the switch point of the valve core is dependent on the strength of the magnets. If the magnets decay, the valve core will switch at an earlier point thus decreasing the stroke of the sealing member.

These devices have not been found to be entirely suitable. The present invention addresses many of the problems discussed above. Specifically, the present invention provides a directional control valve that includes a snap acting magnetic reversing mechanism. The valve may be used with a reciprocating fluid-driven motor which includes a member that is driven by the motor's sealing member. The driven motor includes a magnetic area, and a valve core also includes a magnetic area. Reciprocative movement of the sealing member at a motor frequency causes the driven member to also reciprocate at the motor frequency which further causes, through magnetic coupling, reciprocative movement of the valve core. The valve core snaps from a first position to a second position and back again due to the characteristics of the magnetic interaction between the aforesaid magnetic areas.

The reversing mechanism that is the subject of this application does not include springs to effect the snap action; therefore, the problems associated with the springs, as discussed above, are substantially eliminated. Further, the point at which the valve core switches, with respect to the stroke of the sealing member, is not heavily dependent on the strengths of the magnets in the present invention. Thus, the stroke of the motor should remain constant throughout the life of the motor.

SUMMARY OF THE INVENTION

The present invention is a magnetic snap-action directional control valve mechanism preferably for use with a fluid pressure actuated reciprocating motor. The reversing mechanism includes a two-position valve that provides alternating fluid communication between high pressure fluid and the motor, and low pressure fluid and the motor. A driven member is activated by a sealing member that moves within the motor, so that the driven member reciprocates at the same frequency as the sealing member. A magnetic area on the driven member interacts with a magnetic area on the valve to cause the valve to alternate, in snap action fashion, between a first position and a second position.

BRIEF DESCRIPTION OF THE DRAWINGS

FIG. 4 is a side elevational cross section of the magnetic switching valve body of the embodiment of the invention shown in FIG. 1;

FIG. 5 is an end elevational view of the magnetic switching valve body shown in FIG. 4;

FIG. 6 is a top cross-sectional view of the magnetic switching valve body shown in FIG. 4, taken generally along the line 6—6;

FIG. 7 is a top plan cross-sectional view of the valve slider of the embodiment shown in FIG. 1;

FIG. 8 is an end view of the slider shown in FIG. 7.

DETAILED DESCRIPTION OF THE INVENTION

Figure 1:
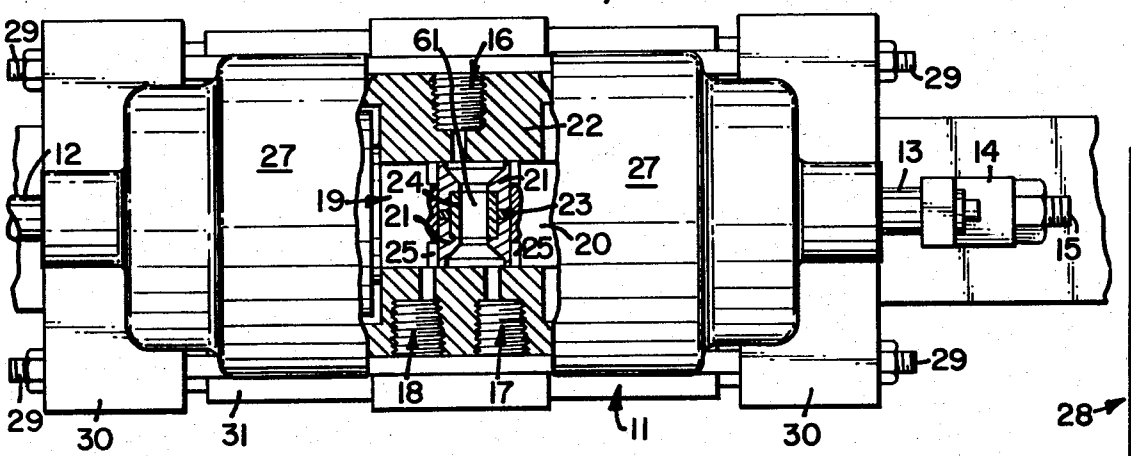
FIG. 1 is a top plan view, partly in section, of an embodiment of the present invention, showing the reversing mechanism and a fluid motor and pump in combination.

Referring now to the drawings wherein like reference numeral denote like elements throughout the several views, FIG. 1 illustrates, partly in section, a top view of a preferred embodiment of the invention, denoted generally by the reference numeral 10. A magnetic switching valve 11 having a first magnet holder 12 and a second magnet holder 13 is shown. The magnet holders 12 and 13 each have a first end and a second end, the first end carrying a magnetic area and the second end of each magnet holder being connected to a tie rod bar 14 which is further connected to a tie rod 15. The interaction of the aforesaid components will be more fully discussed below.

For the purposes of the present application, a "magnetic area" is an area that is capable of being magnetized to form a magnet, or at least is an area that is attracted or repelled by a magnetic field. Furthermore, a "magnetic coupling" or "magnetic interaction" herein refers to the physical force generated on a magnetic area, whether magnetized or not, when subjected to the influence of a magnetic field.

The magnetic switching valve 11 preferably includes four ports. An inlet port 16 is adapted to receive a flow of pressurized fluid from a pressurized fluid source. Fluids that would function in the system include hydraulic oils, water and air. For the purposes of this description of a preferred embodiment of the invention, it will be hereinafter assumed that water is the pressurized fluid that is switched by the magnetic switching valve 11 and is used to power a reciprocating motor as discussed below. The source of the pressurized fluid, water, could be a pump or simply a municipal water supply (not shown).

The magnetic switching valve 11 also includes a first transfer port 17 and a second transfer port 18. The transfer ports 17 and 18 are put into fluid communication with the inlet port 16 depending on the position of a valve core, indicated generally at 19. The valve core 19 has two positions, a first position and a second position. The valve core 19 is shown in FIG. 1 in the first position, allowing water to flow from the inlet port 16 through a bore 61 in the valve core 19 to the first transfer port 17; the second position of the valve core 19 places the inlet port 16 in fluid communication with the second transfer port 18 so that water can flow from inlet port 16 through the bore 61 to the second transfer port 18. The operation of the switching of the magnetic switching valve 11 in conjunction with a water powered motor/pump will be more fully discussed below.

The components of the valve core 19 can now be identified. A valve core body 20, shown partly in section, houses the various components that allow the water to flow either to the first transfer port 17 or the second transfer port 18 from the inlet port 16. The components include two directional bodies 21 that route the flow either to one transfer port to the other depending on the position of the valve core 19, the directional bodies 21 forming a portion of the bore 61. The valve core body 20 is bored through to accommodate the directional bodies 21.

Urging the directional bodies 21 into a sealing relationship with a valve body 22 that forms the inlet and transfer ports 16, 17 and 18, respectively, is an O-ring 23. The directional bodies 21 thereby seal against valve body 22 while allowing the valve core 19 to reciprocate between two positions. A directional body insert 24 has a sliding fit with the directional bodies 21 and radially constrains the O-ring 23 so that a more effective seal between the directional bodies 21 and the valve body 22 can be made. The directional body insert 24 forms a portion of the bore 61. With water as the pressurized fluid that is being switched, the directional bodies 21, the directional body insert 24 and the valve core 19 are preferably made of a plastic material, e.g., nylon. If another pressurized fluid were being used, other materials might be needed and are contemplated by the invention.

When the valve core is in the first position, as shown FIG. 1, the inlet port 16 provides pressurized water for the transfer port 17 via the bore 61, while the transfer port 18 is put into fluid communication with an exhaust channel 25. The exhaust channel 25 allows fluid that was formerly pressurized and used to power the motor/pump to be exhausted as the motor reverses its stroke as more fully discussed below. The valve body 22 includes an exhaust port 26 as shown in FIG. 3.

When the valve core is in the first position as shown in FIG. 1, the exhaust channel 25 is put into fluid communication with the exhaust port 26 so that exhaust flow may proceed through the second transfer port 18, the exhaust channel 25 and finally through the exhaust port 26. When the valve core 19 is in the second position, shuttled to the left with respect to the position of the valve core 19 shown in FIG. 1, the first transfer port 17 is aligned with the exhaust channel 25 and ultimately with the exhaust port 26. As the valve core 19 reciprocates between the first and second positions, the transfer port 17 and 18 are alternately supplied with pressurized fluid from the inlet port 16 and exhausted through the outlet port 26. The inlet port 16, transfer ports 17 and 18, and exhaust port 26 all preferably contain female threads for a standard pressure fitting. Valve end caps 27 mate in a threaded fashion with the valve body 22 and, in addition to housing and sealing the valve core 19, serve to contain the magnets that cause the valve core 19 to reciprocate from one position to the other as more fully described below.

Figure 2:
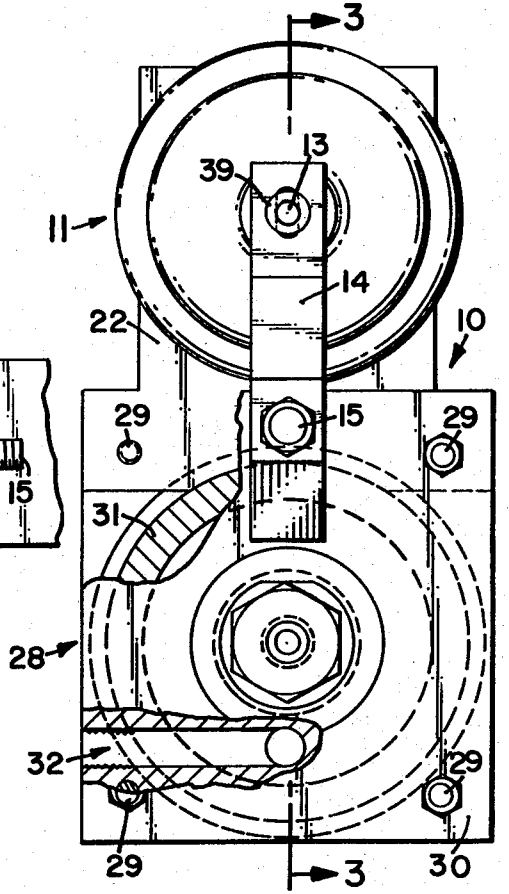
FIG. 2 is an end elevational view, partly section, of the embodiment of FIG. 1.

FIG. 2 shows an end view of a preferred embodiment of the invention, generally indicated at 10. The magnetic switching valve 11 is shown immediately above a motor/pump 28. Tie bolts 29 pull motor/pump end caps 30 inwardly to seal pump body 31 as shown in FIGS. 1 and 3. Tie bar 14 is shown connecting the tie rod 15 with the second magnet holder 13; another such assembly is located at the opposite end of the switching valve 11 with a tie rod bar 14 connecting the tie rod 15 to the first magnet holder 12. Also shown in FIG. 2 is a second pump port 32 that opens into one of the subchambers of the pump created by the pump piston as shown and described with reference to FIG. 3 below. A tube having male fittings on both ends (not shown) is used to connect the second transfer port 18 to the second pump port 32, and a first pump port 33 (shown in FIG. 3) is similarly connected to the first transfer pump 17. The invention contemplates, however, that internal porting could be used in lieu of external tubes. The pump end cap 30 is cut away to show the pump body 31 in cross section.

Figure 3:
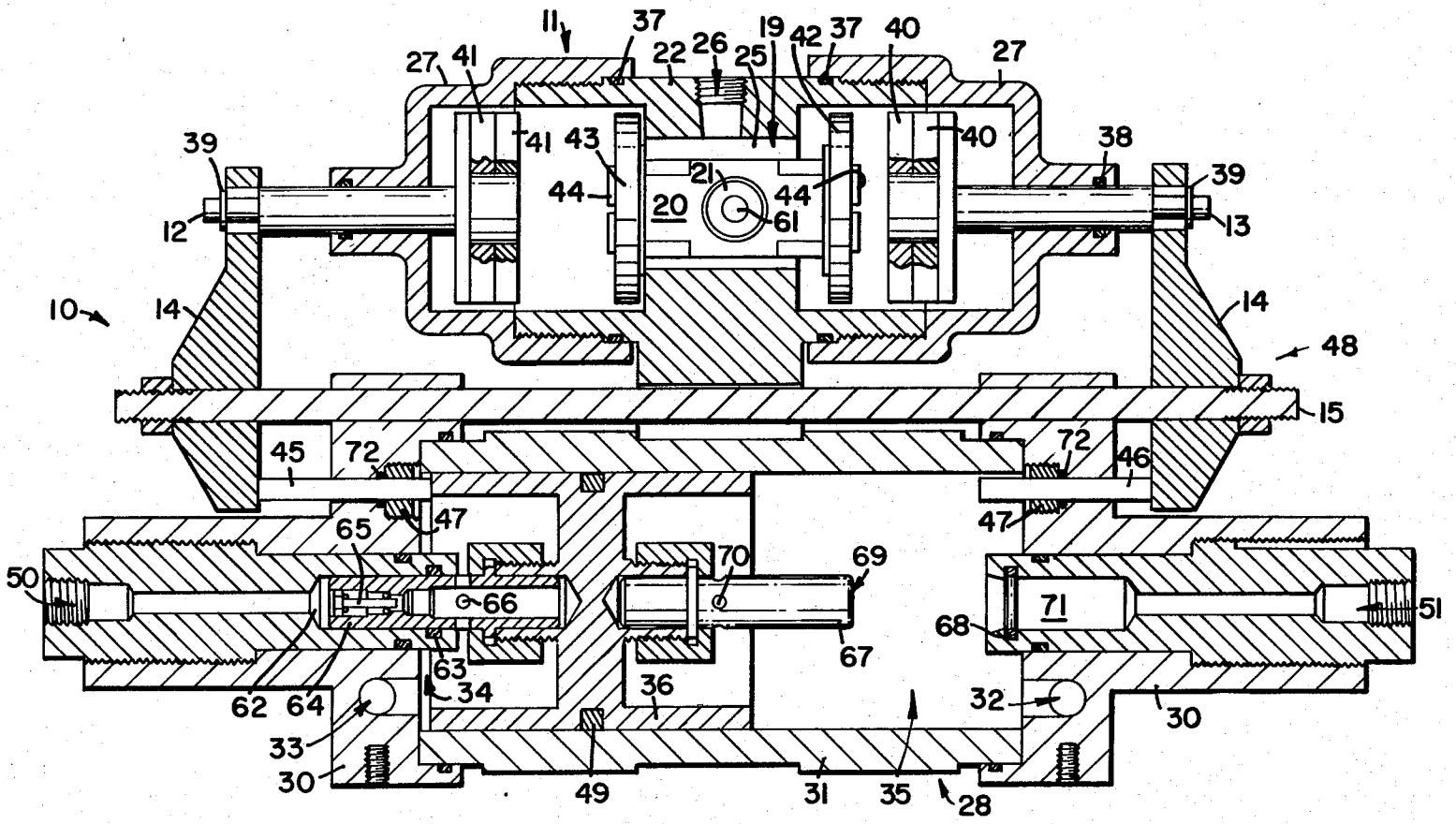
FIG. 3 is a cross sectional view of the embodiment of FIG. 1, taken generally along the line 3—3 shown in FIG. 2.

FIG. 3 shows the preferred embodiment of FIG. 1 in cross section, generally along the line 3—3 of FIG. 2. The magnetic switching valve 11 is shown sitting atop pump 28. It should be noted that the fluid connections between the switching valve 11 and the pump 28 are not shown in FIG. 3. FIG. 3 does show, however, the exhaust port 26 in the switching valve 11 and the pump ports 32 and 33 in the pump end caps 30 that open into a first subchamber 34 and a second subchamber 35 created by a pump piston 36 is the pump body 31.

The overall construction of the switching valve 11 can now be described. The valve end caps 27 are threadedly engaged to the valve body 22 and a seal is ensured by a valve cap seal 37, preferably of a resilient nature. The valve core 19 is shown in its first position, the same position that was illustrated in FIG. 1 as discussed above. Valve end caps 27 are provided with openings that slidably accommodate the magnet holders 12 and 13. Circular seals 38, also preferably having resilient qualities, seal the magnet holders 12 and 13 as they reciprocate in response to the movement of the piston 36 as discussed below.

The magnet holders 12 and 13 are inserted into tie rod bars 14 and are fixed thereto by snap rings 39. At the opposite ends of the magnet holders 12 and 13, within the valve 11, are attached outside magnets 40 and 41. The magnets are preferably permanent and ferromagnetic; ceramic magnets are preferable when water is the pressurized fluid due to the ceramic magnet's corrosion resistance. The outside magnets 40 and 41 may be attached to the magnet holders 13 and 12, respectively, by any convenient and well-known method.

Inside magnets 42 and 43 are attached to the ends of the valve core 19. The inside magnets 42 and 43 are also preferably permanent, ferromagnetic and ceramic. The inside magnets 42 and 43 are attached to the valve core body 20 by stainless steel screws 44. The magnetic interactions between magnets 40 and 42, and 41 and 43, respectively, cause the valve core to reciprocate between the first position, as shown in FIGS. 1 and 3, and the second position so that the pressurized fluid, e.g., water, can be communicated to the first subchamber 34 when the valve core 19 is in the first position as shown in FIGS. 1 and 3 and the pressurized water can be communicated to the second subchamber 35 when the valve core 19 is in the second position. When one of the subchambers is being pressurized due to fluid communication with the inlet port 16, the other pump subchamber is being vented through the exhaust port 26. The movement of the piston 36 causes the magnet holders 12 and 13 and outside magnets 40 and 41 to move which also causes the valve core 19 to move in snap action fashion from one position to the other as will be further discussed below. It should be noted that selected magnets 40, 41, 42 and 43 could be replaced by unmagnetized magnetic areas. That is, for example, the inside magnets 42 and 43 could be unmagnetized iron disks that are attractable by the outside magnets 40 and 41, respectively. Permanent magnets are preferred, however, in all four positions.

The various components of the pump 28 can now be identified and described. Again with reference to FIG. 3, the tie rod bars 14 are attached to push rods 45 and 46, the push rods 45 and 46 extending into the first and second subchambers of the pump, respectively. A seal is made around the push rods 45 and 46 by O-rings 72, preferably made of resilient material and held in place by inserts 47. Thus, it can be seen that the push rods 45 and 46, tie rod bars 14, tie rod 15, magnet holders 12 and 13 and outside magnets 40 and 41 all move as a single unit and in response to the reciprocal movement of the piston 36. This unit may be termed a tie rod assembly and is indicated generally by the reference numeral 48 in FIG. 3. When the piston 36 nears the end of its stroke it contacts one of the push rods 45 and 46 and carries the tie rod assembly 48 in the direction of the piston 36.

The piston 36 slides in pump body 31 and a seal is ensured by a piston seal 49, preferably an O-ring or the like. The piston 36 moves solely in response to the differential fluid pressure across it created by fluid communication with two bodies of fluid, one at a higher pressure than the other. As the piston 36 moves to and fro, it is used, in this preferred embodiment, to pump a particular product. It is understood that the piston 36 could be operatively connected to any device or system that requires linear reciprocal motion and power. In this preferred embodiment, the motion of the piston 46 is used to pump a soap and water solution. The details of the pumping sequence are not a critical part of this invention. The piston 36, starting in its left-most position as shown in FIG. 3, proceeds to the right in response to the differential fluid pressure across it and draws in a liquid pumpage through third pump port 50 and, at the same time, the second subchamber 35 is vented through the second pump port 32 and through the second transfer port 18, the exhaust channel 25 and the exhaust port 26. Upon nearing the end of its rightward stroke, piston 36 contacts push rod 46 and pushes the push rod 46 along, also in a rightward direction. As discussed above, the push rod 46 is a component of the tie rod assembly 48. Thus, the tie rod assembly 48 is pushed to the right which ultimately causes the valve core 19 to switch to the left, as further discussed below. The piston 36 is then forced to move in the opposite direction (left in FIG. 3) in response to a differential pressure across it, drawing pumpage through a fourth pump port 51. Thus, in the embodiment shown in the appended figures, the pumpage is ultimately drawn in through ports 50 and 51 and discharged, along with the fluid that actually reciprocatively drives the piston 36, through the exhaust channel 25 and exhaust port 26. If water is used as the driving fluid and liquid soap as the pumpage, a soap and water solution will be exhausted through the exhaust port 26 and may be subsequently used in a commercial dishwasher, for example. It should be noted that a pair of simple check valves (not shown) should separate the ports 50 and 51 from the supply of pumpage (not shown) so that pumpage can only flow from the pumpage supply to the ports 50 and 51. It should further be noted that any number of pumping schemes could be employed and the invention contemplates any and all such techniques. In the embodiment shown in the appended figures, the pumpage is alternately drawn in through ports 50 and 51. For example, when the piston 36 is near its leftmost position and beginning to travel rightward, as shown in FIG. 3, pumpage will be drawn from the pumpage source, through the check valve (not shown), and through the third pump port 50 into a first cavity 62. This occurs due to a pumping action caused by a sealing engagement between a first seal 63 and a first piston extension 64. Pumpage will continue to be drawn into the first cavity 62 until the piston extension 64 becomes disengaged from the first seal 63, at which time the driving fluid flowing in through first pump port 33 will effectively prevent further influx of pumpage.

Once the piston 36 reaches its rightmost position it will begin moving to the left due to the pressurization of second subchamber 35 and the venting of the first subchamber 34, the latter due to the fluid communication between the first subchamber 34, first pump port 33, exhaust channel 25 and exhaust port 26. As the piston 36 moves to the left the fluid within sub-chamber 34 is discharged through the fluid communication path previously described eventually re-engaging the first piston extension 64 with the first seal 63. At that point, pumpage that formerly resided in the first cavity 62 is driven through a check valve 65 in the first piston extension 64 and into the first subchamber 34 through a first piston port 66. This technique causes a precise amount of pumpage to be metered into the driving fluid. It should be noted that the right side of the piston 36 includes a second piston extension 67 and associated therewith a second seal 68, a second check valve 69 (not shown; within a second piston extension 67) and a second piston port 70. A second cavity 71 is also on the right hand side and functions similarly to the first cavity 62. It should also be noted that it is possible to configure the piston extensions 64 and 67 so that they do not become disenagaged from the seals 63 and 68, respectively. Also, as clear to those skilled in the art of pump design, it is possible to eliminate the check valves 65 and 69 and piston ports 66 and 70 and provide another pair of check valves external to the pump so that there are, in all, four check valves external to the pump, thus reducing the complexity of the piston and attendant components.

FIG. 4 shows a cross-sectional elevational view of the valve body 22. The orientation of the valve body 22 is the same as shown in FIG. 3. Exhaust port 26 and inlet port 16 are shown. A valve body tie rod guide 45 is visible as well. FIG. 5, an end view of the valve body 22, also shows the valve body tie rod guide 45. A pair of valve body tie bolt holes 46 accommodate a pair of tie bolts 29, shown in FIG. 1. There preferably exists a sliding fit between the tie bolts 29 and the valve body tie bolt holes 46. The valve body 22 further has a valve body aperture 60 that carries the valve core 19 as shown in FIG. 1.

FIG. 6 is a top cross-sectional view of the valve body 22 and shows the inlet port 16 and first and second transfer ports 17 and 18, respectively. The valve body aperture 60 is shown as well.

The valve body aperture 60 carries the valve core body 20. The valve core body 20 is shown in cross section in FIG. 7 and an end view is shown in FIG. 8. The valve core body 20 includes two threaded holes 59 that accept stainless steel screws 44 which attach inside magnets 42 and 43 to the valve core body 20 as better seen in FIG. 3. A directional body guide 51 is formed by the vave core body 20 and houses directional bodies 21, directional body insert 24 and O-ring 23, the directional bodies 21 and insert 24 forming bore 61 through which the driving fluid passes. A notch 52 is also formed by the valve core body 20 and constitutes the exhaust channel 25 when the valve core 19 is assembled and inserted in the valve body aperture 60.

FIG. 8 shows another view of the valve core body 20 and particularly shows the overall rectangular shape of the valve core body 20, a shape that fits in sliding fashion in valve body aperture 60. A body top surface 53 is in a sliding relationship with an aperture surface 54 as shown in FIG. 5.

The operation of the preferred embodiment 10 can now be summarized. With the valve core 19 in the first position as shown in FIG. 3, the inlet port 16 is in fluid communication with the first transfer port 17 via the bore 61. The first transfer port 17 is also in fluid communication with the first pump port 33 through external tubing not shown in the figures, thus allowing pressurized fluid to enter the first subchamber 34. At the same time, the second subchamber 35 is placed in fluid communication with the exhaust port 26 via the second pump port 32, the second transfer port 18 and the exhaust channel 25. The differential pressure across the piston 36 causes it to move from left to right drawing pumpage in through the third pump port 50.

Still with reference to FIG. 3, when the piston 36 near the end of its rightward travel it contacts the right push rod 46 and causes the tie rod assembly 48 to move from left to right as the piston continues to move to the right. As the tie rod assembly 48 moves to the right, the magnetic interaction between the right magnets 40 and 42 diminishes while the interaction between the left magnets 41 and 43 increases. When the piston 36 nears the end of its rightwward stroke, the right magnetic interaction has diminished and the left interaction has increased to the point that the valve core 19 snaps from the first position as shown in FIG. 3 to the second position, shuttling to its leftmost position. It should again be noted that magnets 40, 41, 42 and 43 could selectively be replaced by unmagnetized magnetic areas. Additionally, in the event that permanent magnets are utilized in all four positions as in the preferred embodiment shown in the figures, it is not necessary that the poles of the magnets be aligned such that the right magnets 40 and 42 attract one another and the left magnets attract one another. In the preferred embodiment shown in the figures, however, the outside magnets 40 and 41 do attract the inside magnets 42 and 43, respectively.

With the valve core 19 in the second position, the inlet port 16 is in fluid communication through the bore 61 and external tubing (not shown) with the second subchamber 35 of the pump 28. The exhaust port 26 is in fluid communication with the first subchamber 34. The piston 36 is thus caused to move from right to left and eventually reaches the position shown in FIG. 3 which causes the valve core 19 to snap from its second position to its first position as shown in FIG. 3. The process will continue indefinitely so long as a pressurized fluid is supplied to the magnetic switching valve 11 and a lower pressure body of fluid is connected to the exhaust port 26. Again it should be noted that although the preferred embodiment shown in FIG. 3 shows the magnetic switching valve 11 incorporated into a reciprocating pump system, the magnetic switching valve 11 could be used in any system where it is desirable to switch a flow from one port to another.

Numerous characteristics and advantages of the invention have been set forth in the foregoing detailed description. It will be understood that this disclosure is in many respects only illustrative. Changes may be made in details, particularly in matters of shape, size, and arrangement of parts without exceeding the scope of the invention. The scope of the invention is defined in the language in which the appended claims are expressed.

I claim:

1. A reversing mechanism for use with a fluid pressure actuated motor of the type having a piston reciprocally movable in a piston chamber at a piston frequency, said piston dividing said piston chamber into first and second subchambers, said reversing mechanism comprising:

(a) a valve body defining therewith an interior chamber having an inlet port, outlet port, and first and second transfer ports, said inlet port adapted to receive a flow of pressurized fluid, said interior chamber having a first opening at a first end and a second opening at a second end;

(b) means for switching the flow of pressurized fluid from said inlet port between said first and second transfer ports, said switching means having a first magnetic area and a second magnetic area wherein when said switching means is in a first position the pressurized fluid flows to said first transfer port and when said switching means is in a second position the pressurized fluid flows to said second transfer port, said switching means positioned within said interior chamber between said first and second ends of said interior chamber;

(c) a tie rod assembly having first and second magnetic holders, said first holder positioned in said first opening of said interior chamber and said second holder positioned in said second opening of said interior chamber, said holders slidable in said interior chamber, and a tie rod cooperatively connecting said first and second holders;

(d) means for reciprocally driving said tie rod in a lateral direction, movement of said piston activating said driving means; and (e) means for magnetically moving said switching means between said first position and said second position at said piston frequency, said first position of said switching means bein effected by an increased magnetic coupling between first magnetic areas and a decreased magnetic coupling between said second magnetic areas, and said second position of said switching means being effected by an increased magnetic coupling between said second magnetic areas and a decreased magnetic coupling between said first magnetic areas.

2. A reversing mechanism as recited in claim 1, wherein mechanical power generated by said fluid pressure actuated motor is used to drive a pump.

3. A reversing mechanism for use with a fluid pressure actuated motor of the type having a sealing member reciprocally movable in a motor chamber at a motor frequency, said sealing member dividing said motor chamber into first and second subchambers, said reversing mechanism comprising:

(a) a valve having a core, said core having a first position and a second position, and said core having a first magnetic area;

(b) a driven member having a first magnetic area; and (c) means for reciprocally driving said driven motor at said motor frequency, wherein said driving means comprises a firt push rod having a first end and a second end and a second push rod having a first end and a second end, said second ends of said push rods cooperatively connected to said driven member and wherein said first end of said first push rod cooperatively engages said sealing member in said first subchamber and said first end of said second push rod cooperatively engages said sealing member in said second subchamber, whereby movement of said sealing member reciprocally activates said first and second push rods and a magnetic coupling between said first magnetic areas causes said core to reciprocate between said first position and said second position, said first position allowing fluid communication between a body of fluid at a first pressure and said first subchamber, and said second position allowing fluid communication between a body of fluid at a second pressure, different from said first pressure, and said first subchamber.

4. A reversing mechanism as recited in claim 3, wherein said driven member comprises means for interconnecting said second ends of said push rods whereby said interconnecting means reciprocates at said motor frequency in response to movement of said sealing member and said first magnetic area of said driven member is cooperatively carried by said interconnecting means.

5. A reversing mechanism as recited in claim 4, wherein said core further comprises a second magnetic area and said driven member further comprises a second magnetic area, said first position of said core being effected by an increased magnetic coupling between said first magnetic areas and a decreased magnetic coupling between said second magnetic areas, and said second position of said core being effected by an increased magnetic coupling between said second magnetic areas and a decreased magnetic coupling between said first magnetic areas.

6. A reversing mechanism as recited in claim 5, wherein said interconnecting means comprises a tie rod having a first end and a second end, a first tie rod bar and a second tie rod bar, wherein said first tie rod bar operatively connects said first end of said tie rod to said second end of said first push rod, said second tie rod bar operatively connects said second end of said tie rod to said second end of said second push rod, said first tie rod bar cooperatively engages a first magnet holder the cooperatively carries said first magnetic area of said driven member, and said second tie rod bar cooperatively engages a second magnet holder that cooperatively carries said second magnetic area of said driven member.

7. A reversing mechanism as recited in claim 6, wherein mechanical power generated by said fluid pressure actuated motor is used to drive a pump.

8. A reversing mechanism for use with a fluid pressure actuated motor of the type having a sealing member reciprocally movable in a motor chamber at a motor frequency, said sealing member dividing said motor chamber into first and second subchambers, said reversing mechanism comprising:

(a) A valve body defining therewith an interior chamber having an inlet port and first and second transfer ports, said ports adapted to receive a flow of propulsive fluid and said first transfer port adapted to be in fluid communication with said first subchamber and said second transfer port adapted to be in fluid communication with said second subchamber;

(b) means for switching the flow of propulsive fluid from said inlet port between said first and second transfer ports, said switching means having a first magnetic area and said switching means positioned within said interior chamber, wherein when said switching means is in a first position said inlet port is in fluid communication with said first transfer port, and when said switching means is in a second position said inlet port is in fluid communication with said second transfer port;

(c) a driven member having a first magnetic area; and (d) means for reciprocally driving said driven member at said motor frequency comprising a first push rod having a first end and a second end and a second push rod having a first end and a second end, said second ends of said push rods cooperatively connected to said driven member, wherein said first end of said first push rod cooperatively engages said sealing member in said first subchamber and said first end of said second push rod cooperatively engages said sealing member in said second subchamber, whereby movement of said sealing member reciprocally activates said first and second push rods and a magnetic coupling between said first magnetic areas causes said switching means to reciprocate between said first position and said second position.

9. A reversing mechanism as recited in claim 8, wherein said driven member comprises means for interconnecting said second ends of said push rods whereby said interconnecting means reciprocates at said motor frequency in response to movement of said sealing member and said magnetic area of said driven member is cooperatively carried by said interconnecting means.

10. A reversing mechanism as recited in claim 9, wherein said switching means further comprises a second magnetic area and said driven member further comprises a second magnetic area, said first position of said switching means being effected by an increased magnetic coupling between said first magnetic areas and a decreased magnetic coupling between said second magnetic areas, and said second position of said switching means being effected by an increased magnetic coupling between said second magnetic areas and a decreased magnetic coupling between said first magnetic areas.

11. A reversing mechanism as recited in claim 10, wherein said interconnecting means comprises a tie rod having a first end and a second end, a first tie rod bar and a second tie rod bar, wherein said first tie rod bar operatively connects said first end of said tie rod to said second end of said first push rod, said second tie rod bar operatively connects said second end of said tie rod to said second end of said second push rod, said first tie rod bar cooperatively engages a first magnet holder that cooperatively carries said first magnetic area of said driven member, and said second tie rod bar cooperatively engages a second magnet holder that cooperatively carries said second magnetic area of said driven member.

12. A reversing mechanism as recited in claim 11, wherein said interior chamber has a first opening at a first end and a second opening at a second end, and wherein said first magnetic holder is positioned in said first opening and said second magnet holder is position in said second opening.

13. A reversing mechanism as recited in claim 12, wherein mechanical power generated by said fluid pressure actuated motor is used to drive a pump.

14. A reversing mechanism for use with a fluid pressure actuated motor of the type having a sealing member reciprocally movable in a motor chamber at a motor frequency, said sealing member dividing said motor chamber into first and second subchambers, said reversing mechanism comprising:

(a) a vave body defining therewith an interior chamber having an inlet port, outlet port and first and second transfer ports, said ports adapted to receive a flow of propulsive fluid and said first transfer port adapted to be in fluid communication with said first subchamber and said second transfer port adapted to be in fluid communication with said second subchamber;

(b) means for switching the flow of propulsive fluid from said inlet port between said first and second transfer ports, said switching means having a first magnetic area and said switching means positioned within said interior chamber, wherein when said switching means is in a first position said inlet port is in fluid communication with said first transfer port and said outlet port is in fluid communication with said second transfer port, and when said switching means is in a second position said inlet port is in fluid communication with said second transfer port and said outlet port is in fluid communication with said first transfer port;

(c) a driven member having a first magnetic area; and (d) means for reciprocally driving said driven member at said motor frequency, wherein said driving means comprises a coupling member, said coupling member cooperatively engaging said sealing member, whereby movement of said sealing member activates said driving means and a magnetic coupling between said first magnetic areas causes said switching means to reciprocate between said first position and said second position.

15. A reversing mechanism as recited in claim 16, wherein said coupling member comprises a first push rod having a first end and a second end and a second push rod having a first end and a second end, said second ends of said push rods cooperatively connected to said driven member, and wherein said first end of said first push rod cooperatively engages said sealing member in said first subchamber and said first end of said second push rod cooperatively engages said sealing member in said second subchamber.

16. A reversing mechanism as recited in claim 15, wherein said driven member comprises means for interconnecting said second ends of said push rods whereby said interconnecting means reciprocates at said motor frequency in response to movement of said sealing member and said first magnetic area of said driven member is cooperatively carried by said interconnecting means.

17. A reversing mechanism as recited in claim 16, wherein said switching means further comprises a second magnetic area and said driven member further comprises a second magnetic area, said first position of said switching means being effected by an increased magnetic coupling between said first magnetic areas and a decreased magnetic coupling between said second magnetic areas, and said second position of said switching means being effected by an increased magnetic coupling between said second magnetic areas and a decreased magnetic coupling between said first magnetic areas.

18. A reversing mechanism as recited in claim 17, wherein said interconnecting means comprises a tie rod having a first end and a second end, a first tie rod bar and a second tie rod bar, wherein said first tie rod bar operatively connects said first end of said tie rod to said second end of said first push rod, said second tie rod bar operatively connects said second end of said tie rod to said second end of said second push rod, said first tie rod bar cooperatively engages a first magnet holder that cooperatively carries said first magnetic area of said driven member, and said second tie rod bar cooperatively engages a second magnet holder that cooperatively carries said second magnetic area of said driven member.

19. A reversing mechanisnm as recited in claim 18, wherein mechanical power generated by said fluid pressure actuated motor is used to drive a pump.

* * * * *

UNITED STATES PATENT AND TRADEMARK OFFICE

CERTIFICATE OF CORRECTION

PATENT NO. : 4,509,402

DATED : April 9, 1985

INVENTOR(S) : Duane L. Salmonson

It is certified that error appears in the above-identified patent and that said Letters Patent are hereby corrected as shown below:

Column 1, line 26, "poston" should be --piston--.

Column 1, line 44, "occupied" should be --coupled--.

Column 2, line 59, "motor" should be --member--.

Column 5, line 38, "pump" should be --port--.

Column 8, line 28, "vave" should be --valve--.

Column 10, line 30, "firt" should be --first--.

Column 12, line 38, "vave" should be --valve--.

Column 13, line 1, "16" should be --14--.

Signed and Sealed this

*Seventh* Day of *January 1986*

[SEAL]

*Attest:*

DONALD J. QUIGG

*Attesting Officer*

*Commissioner of Patents and Trademarks*